United States Patent [19]

Jackson

[11] 4,269,554

[45] May 26, 1981

[54] WELL PIPE HANDLING EQUIPMENT

[76] Inventor: Lewis B. Jackson, 45 Scenic Cir., Croton-On-Hudson, N.Y. 10520

[21] Appl. No.: 66,413

[22] Filed: Aug. 14, 1979

[51] Int. Cl.[3] ..... G01L 1/02

[52] U.S. Cl. ..... 414/22; 414/745; 294/102 A

[58] Field of Search ..... 414/22, 745; 175/52, 175/85; 294/88, 117, 90, 102 A

[56] References Cited

U.S. PATENT DOCUMENTS

| | | | |
|---|---|---|---|
| 3,494,484 | 2/1970 | McFadden | 294/90 X |
| 3,499,498 | 3/1970 | Bromell et al. | 414/22 X |
| 3,759,092 | 9/1973 | Fishel | 414/5 X |
| 3,888,362 | 6/1975 | Fletcher et al. | 414/626 X |
| 3,904,234 | 9/1975 | Hill | 414/5 X |
| 3,949,883 | 4/1976 | Crooke et al. | 414/22 X |
| 4,042,123 | 8/1977 | Sheldon et al. | 414/22 |

*Primary Examiner*—Allen N. Knowles
*Attorney, Agent, or Firm*—Dressler, Goldsmith, Shore, Sutker & Milnamow, Ltd.

[57] ABSTRACT

An apparatus and method for facilitating the transfer of pipe sections between a vertical storage array and a power operated pipe elevator. A travelling block is equipped with a measuring arm to position the elevators relative to a pipe stand to be added to the drill string and taken from the storage array by a hydraulically powered pipe transfer device. After insertion of pipe by the transfer device, the elevators are automatically actuated by a contact arm mounted on the elevators. The contact arm signals the actuation of the elevators and withdraws transfer device. Pipe transfer from the storage array to the elevators and back again is semi automatic and under the supervision of the drilling crew.

16 Claims, 19 Drawing Figures fig. 2
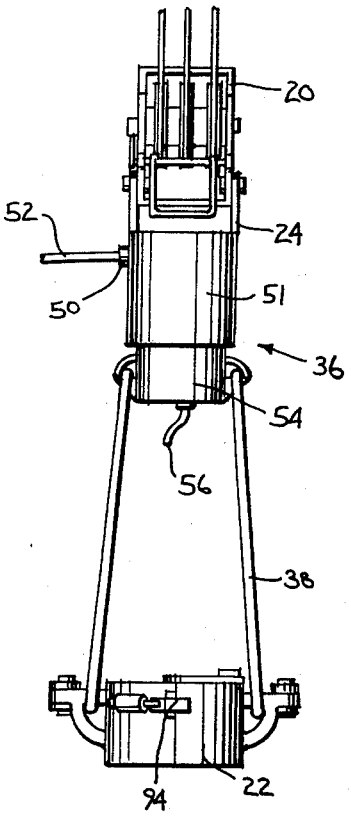
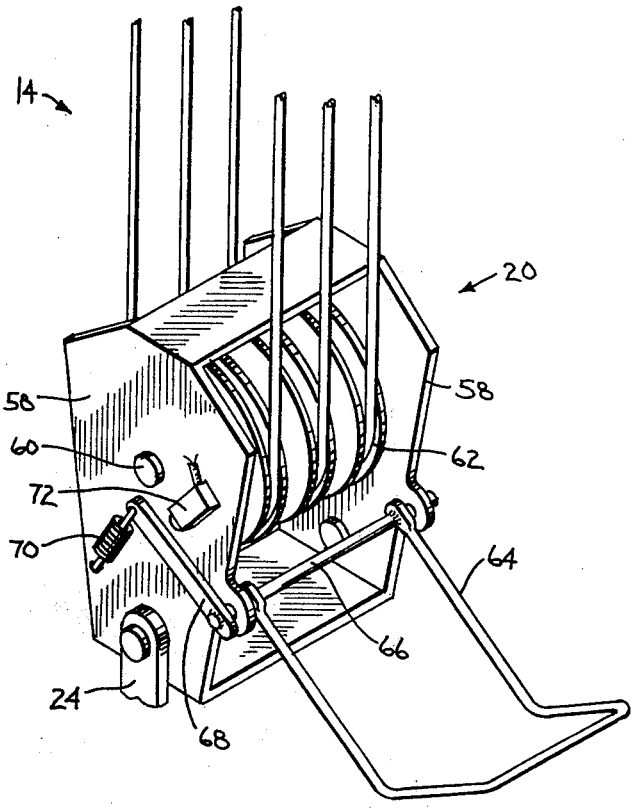
fig. 3
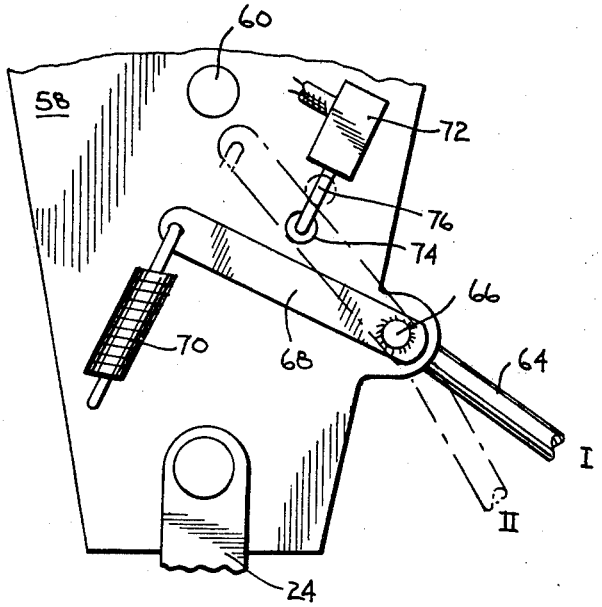
fig. 4

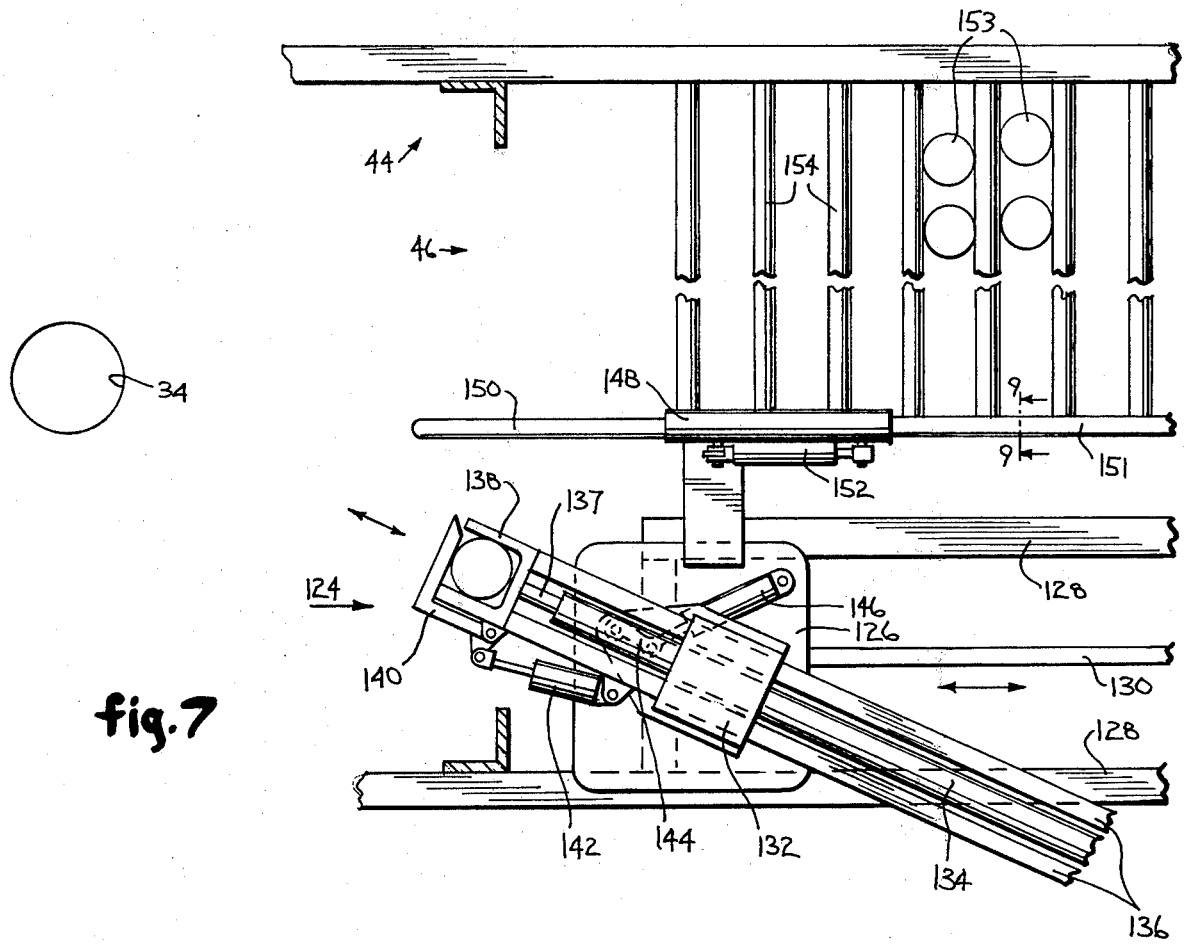
fig. 7
fig. 8
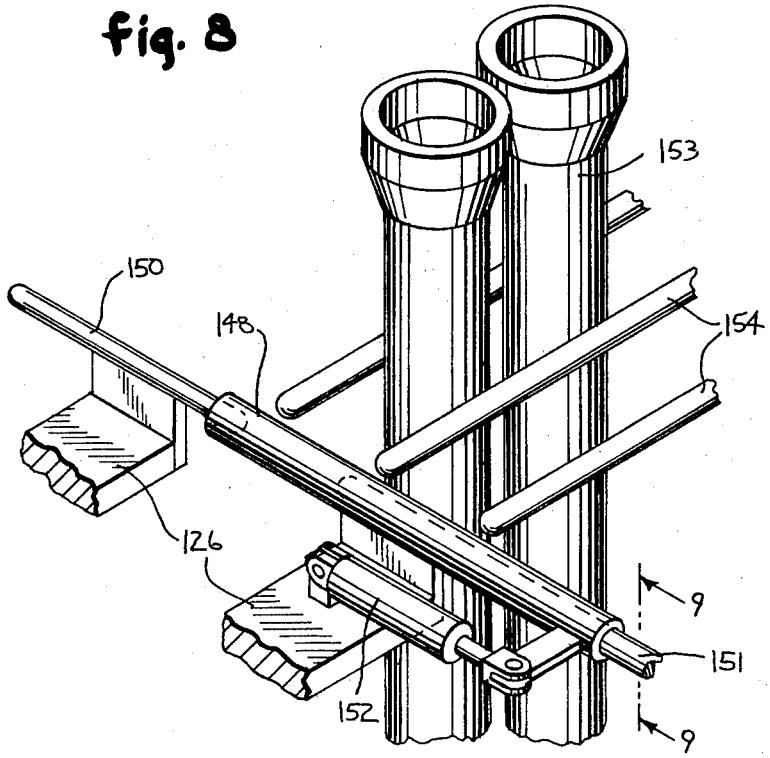
fig. 9
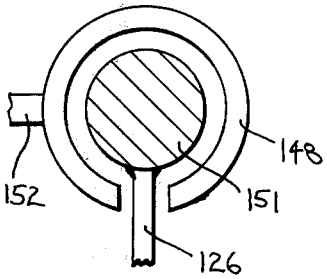

WELL PIPE HANDLING EQUIPMENT

DESCRIPTION

TECHNICAL FIELD

An apparatus for the insertion and withdrawal of drill pipe from an oil well. A simple and inexpensive method to improve the speed and safety of pipe handling operations at the well head.

BACKGROUND OF THE INVENTION

The continuing need for more oil at lower operating costs has motivated inventors to develop pipe handling schemes and equipment. Various types of pipe handling or pipe racking apparatus for moving pipe sections between a storage array and the drill string of an oilwell or derrick have been disclosed U.S. Pat. No. 2,416,815 by I. X. Calhoun describes one such mechanism. Others have included control schemes or suggested methods where some of these operations could be automated. U.S. Pat. No. 3,800,962 by J. E. Ham is an example.

Normally, a drilling crew includes a person known as the "derrick man" or "tower man" who stands on a working platform (sometimes called the fourble board) high on the drilling rig. After the lower end of a pipe section has been disconnected from the drill string and properly placed in storage by a "floor operator", the tower man manually unlatches the pipe elevator from the upper end of the pipe section, removes the top of the pipe section from the pipe elevator, and locates the pipe section in the derrick for storage.

After a new drill bit has been installed, the drill string is reconstructed by recoupling the sections of pipe stored within the derrick. In this case, the derrick draw works is actuated to raise the pipe elevator until it is at the proper elevation for attaching a section of pipe. In this situation, the tower man manually pulls the upper end of a section of pipe from the storage array and loads the upper end into the pipe elevator. Once loaded into the pipe elevator, the pipe section is lifted off the tower floor and joined into the drill string attached to the drill bit. Those familiar with these duties of tower man realize that it is somewhat dangerous and fatiguing and not especially suitable for speedy operation.

SUMMARY OF THE INVENTION

In accordance with the present invention, well pipe handling equipment is provided for use in conventional drilling operations and those operations utilizing power operated drill pipe racking equipment, vertical pipe storage, and power operated pipe elevators actuated in response to the orders of the drilling crew. Equipment incorporating the present invention minimizes the fatigue and danger present in pipe handling operations at the wellhead and increases the speed of pipe section and drill bit changing operations.

Conventional power swivels, travelling blocks, pipe elevators, and other components of proven reliability are combined in a unique configuration to achieve results heretofore achieved by expensive customized equipment beyond the reach of independent oil well owners and often too specialized for widespread acceptance by the industry.

One unique aspect is that the pipe elevators do not have to be moved out of the way or kept within fixed guides when pipe racking equipment is used (e.g. Paget U.S. Pat. No. 3,061,011). Unlike prior schemes to expedite the handling of pipe, track sensors and fixed guides for the pipe elevators and hoisting gear are not employed (e.g. Sheldon U.S. Pat. No. 4,139,891). This reduces cost, in that fewer modifications or additions to the tower need to be made. Finally, equipment down time is reduced in that there are fewer limit switches and sensors to calibrate and keep in adjustment. The present invention is self-adjusting to the length and size of the pipe sections used in the drill string.

In order to add pipe sections to the drill string of a well, a pipe section is first removed from a vertical storage array using a remotely controlled transfer arm under the direction of the drilling crew. The travelling block is then raised. Next, the transfer arm is extended in the direction of the vertical axis of travel of the pipe elevator and travelling block. This depresses a measuring arm carried by the travelling block which together with the elevators is moving vertically upward.

When the measuring arm passes beyond the upper end of the pipe section held by the transfer arm, the measuring arm is released. This signals that, after the travelling block has been raised a fixed distance further upward, the end of the pipe section will be properly related in elevation to the moving elevators to allow successful placement of the pipe section into the elevators.

When the pipe section is within the compass of the pipe elevator, a position sensor is actuated causing the pipe elevator to close about the pipe section. A latch holds the pipe elevator shut. Since the pipe section is now supported by the pipe elevator, the transfer arm is disengaged from the pipe section and withdrawn to a position in the vertical pipe storage array ready to accept another section of pipe.

After the pipe section is connected to the drill string, the elevators and drill string are lowered, and the elevators are removed. The process is repeated until the desired length of drill string is reached. A similar procedure is used to remove pipe from the drill string and transfer the pipe into storage.

Numerous other advantages and features of the present invention will become readily apparent from the following detailed description of the invention and of one embodiment thereof, from the claims and from the accompanying drawings.

BRIEF DESCRIPTION OF THE DRAWINGS

FIG. 2 is an enlarged view of those portions of the present invention supported by the derrick cable system;

FIG. 3 is a perspective view of a travelling block incorporating a measuring arm;

FIG. 4 is a detailed view of the frame shown in FIG. 3;

FIG. 7 is a plan view of the pipe transfer means and pipe storage means;

FIG. 8 is a perspective view of the pipe gate portion of the storage means illustrated in FIG. 7;

FIG. 9 is a detailed cross-sectional view of the pipe gate shown in FIGS. 7 and 8;

DETAILED DESCRIPTION

This invention may be used in many different forms. This specification and the accompanying drawings disclosed only one specific form as an example of the use of the invention. The invention is not intended to be limited to the embodiment illustrated, and the scope of the invention will be pointed out in the appended claims.

The terms derrick, oil drilling rig and well as utilized herein include the various types of apparatus for running conduit into and out of bores within the surface of the earth, both fixed and portable.

Figure 1:
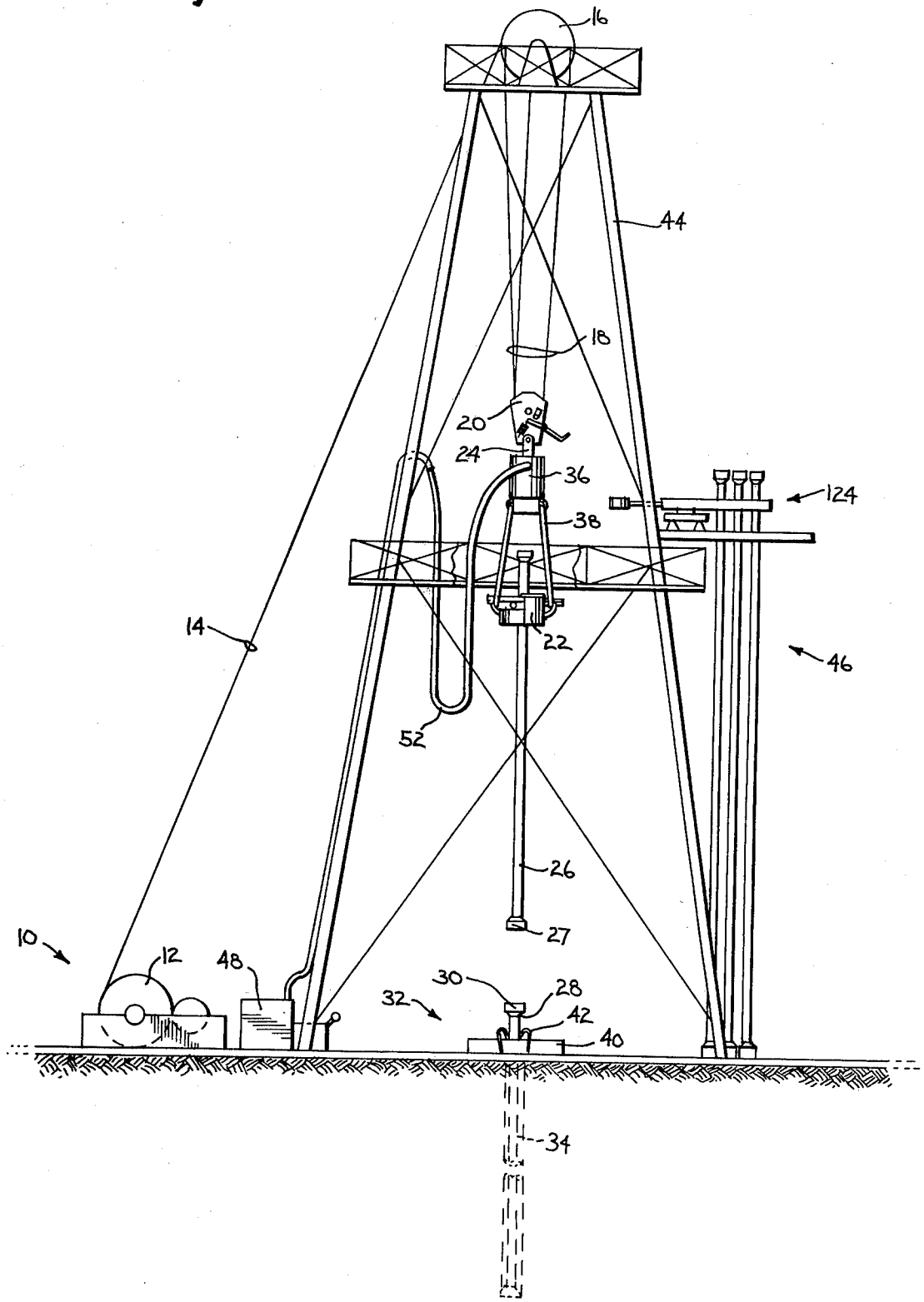
FIG. 1 is an overall view of the equipment used in oilwell drilling incorporating the present invention.

FIG. 1 illustrates the overall arrangement of equipment associated with rotary oil drilling rigs. The draw works or hoisting mechanism 10 has a hoisting drum 12 on which the hoisting cable 14 is wound. This cable extends upwardly from the drum, around a guide sheave (not shown) at the top of the derrick, and from this guide sheave around a crown block 16 containing multiple top sheaves. The multiple strands or reeves 18 of the hoisting cable extending from the crown block 16 pass around the sheaves of a travelling block 20 from which an automatic pipe elevator 22 is suspended.

The travelling block 20 is a frame containing multiple sheaves attached to a hook means 24. It accommodates the hoisting cable 14 via the derrick crown block 16 to provide the means of hoisting or lowering a drill pipe section 26 and other movable loads. The term "running rigging" will be used to refer to that which is carried by the reeves 18 suspended from the crown block 16.

The drill pipe section 26 is typically of a tubular body having an axial fluid passageway extending centrally therethrough. The pipe body has a drill collar 28 at the box end 30 of the pipe section. The drill collar 30 provides a downwardly facing shoulder for support by the pipe elevator 22 during hoisting and lowering of the pipe section by the travelling block 20. One section of drill pipe, about 20 to 30 feet in length and fitted with a tool joint box connection at the top and tool joint pin connection at the bottom, is referred to as a "single". Usually, three or more sections of pipe (called a "drill stand" or "pipe stand") are withdrawn at a time.

Power tongs (not shown) are located above the well head 32 to disconnect or connect threaded sections of pipe into the tubing string 34. Because of the rotation accompanying the insertion or withdrawal of drill pipe, a swivel 36 is provided. The system comprised of the travelling block 20, hook means 24, swivel 36, and pipe elevator 22 defines the "hook structure".

The pipe elevator 22 (alternatively referred to as "the elevators") is composed of pivotally interconnected annular body sections or jaws which are hinged apart to provide a lateral opening for the insertion of drill pipe. The pipe elevator 22 is joined to the swivel 36 by means of the bales 38. When the jaws are closed, they act as a yoke to suspend the enclosed drill pipe; therefore, when the hoisting cable is wound in or paid out, the drill pipe may be raised or lowered as desired.

It is necessary to periodically remove the drill pipe from the well (e.g., to insert a new drill bit). In such a case, the draw works 10 are actuated to cause the cable system to lower the travelling block 20 and elevators 22 until the elevators can be attached to the upper end of the tubing string 34 extending from the well bore. The draw works 10 are then actuated to raise the travelling block 20, elevators 22 and the accompanying tubing string 34.

The drill pipe is pulled from the well through the rotary table 40 by means of the hook structure until a stand of pipe has cleared "the slips" 42. Slips 42 are steel wedges fitted with replaceable teeth like inserts which drop into position in the rotary table master bushings (not shown) to hold the drill pipe or casing in the rotary table when connecting or disconnecting joints of pipe to the string.

A set of power operated tongs (not shown) is used to break the threaded sections of pipe. This operation is under the control of the derrick man stationed at the base of the derrick. The pipe stands are then stacked upright in the derrick 44 or in an adjacent storage means 46.

FIG. 2 shows an overall outline view and relationship of the travelling block 20, swivel 36, bales 38 and elevators 22 as they would appear from the front of the drilling rig. Although this application describes pneumaticly or hydraulicly powered components, the same principles would apply if alternatively powered components were used.

The swivel 36 is joined to the elevator body section by means of bales 38. The swivel 36 is joined to the travelling block 20 by the hook means 24. The swivel provides a means for transferring a source of fluid power 48 (See FIG. 1) at the tower base to the elevators 22 and the travelling block 20. This fluid is introduced at a connection point 50 that is part of the stationary portion 51 of the swivel via suitable conduit 52 from the source of fluid power 48. After passing through the inner body or rotatable portion 54 of the swivel, pressurized fluid is introduced to the elevators and other portions of the hook structure via additional conduit 56. In addition pressurized fluid may pass through control devices fixed to the stationary portion of the other parts of the running rigging.

Referring to FIG. 3, the travelling block 20 follows conventional principles. It includes an enclosing frame 58, an axle 60 and a number of sheeves 62 revolving about the axle and confined within the frame. The hook means 24 is pivotally joined to the frame 58.

With respect to the invention at hand, the travelling block 20 includes a measuring arm 64 which is pivoted to the frame 58 by a pin or shaft 66. A camming arm 68 is keyed to the shaft 66.

In the embodiment illustrated in FIGS. 3 and 4, the camming arm 68 and the measuring arm 64 are keyed to the common shaft 66 extending between the two faces 58 of the travelling block. The camming arm 68 is joined to a spring or other suitable biasing means 70 to urge the measuring arm 64 to an extended position or first position (I) shown in solid lines in FIG. 4. The other end of the spring is suitably affixed to the frame 58 of the travelling block.

The measuring arm 64 and camming arm 68 are used to activate an electrical limit switch 72 of conventional design. As shown in FIG. 4. depression of the measuring arm 64 is sensed by the electrical switch 72 by virtue of a follower 74 attached to the contact arm 76. The switch 72 controls solenoid valves (not shown) and other components of the control system. The control system directs the flow of pressurized fluid to activate hydraulically actuated assemblies carried on the hook structure or to operate the pipe transfer means.

In operation, the measuring arm 64 is biased to an extended position (I). The switch 72 is actuated when the measuring arm 64 is moved to a depressed position, position II, shown in phantom outline in FIG. 4. The measuring arm 64 is depressed by and remains in the depressed position so long as the travelling block 20 is adjacent to and below the upper end of a stand of pipe placed in the immediate vicinity of the vertical axis of travel of the travelling block 20.

When the measuring arm 64 passes the upper end of the pipe stand, the measuring arm is released to the extended or first position, I, to operate switch 72. The operation of this switch thus provides a signal or indication that the pipe stand may be inserted into the elevators without interferring with the upward motion of the travelling block, swivel, or cable system. More specifically, a fixed further distance must be traversed by the elevators before the pipe stand can be inserted into the moving elevators. The measuring arm thus provides a means for dynamically relating the top of each stand of pipe to the position of the moving pipe elevators. In practice, a pulse generator which generates pulses as the travelling block moves upwardly (for example, one pulse per inch of elevation change) has been found suitable for insuring that the travelling block has been raised to the required height. When the number of pulses generated after arm 64 passes the end of the pipe, reaches a preselected value, the elevators are at the proper height for the control system to initiate insertion of the pipe stand. It should also be noted that intermediate pulse count totals could be used to signal that, for example, the travelling block is above the end of the pipe stand so that the transfer arm can advance the pipe stand in incremental steps prior to the final insertion. Under such a scheme, the overall time to transfer pipe is shortened thereby improving efficiency. As will be explained in greater detail below, this measuring arm signal is used to activate the transfer arm to automatically insert a pipe stand into the elevators. In that sense it forms a "permissive interlock" for the remaining portions of the pipe transfer apparatus.

Much of the equipment described below uses fluid-powered (i.e., hydraulic or pneumatic) piston and cylinder assemblies or linear actuators. A description of the fluid-powered piston and cylinder assemblies used in the invention is not provided since it follows conventional principles well known to a person skilled in the art.

Figure 5:
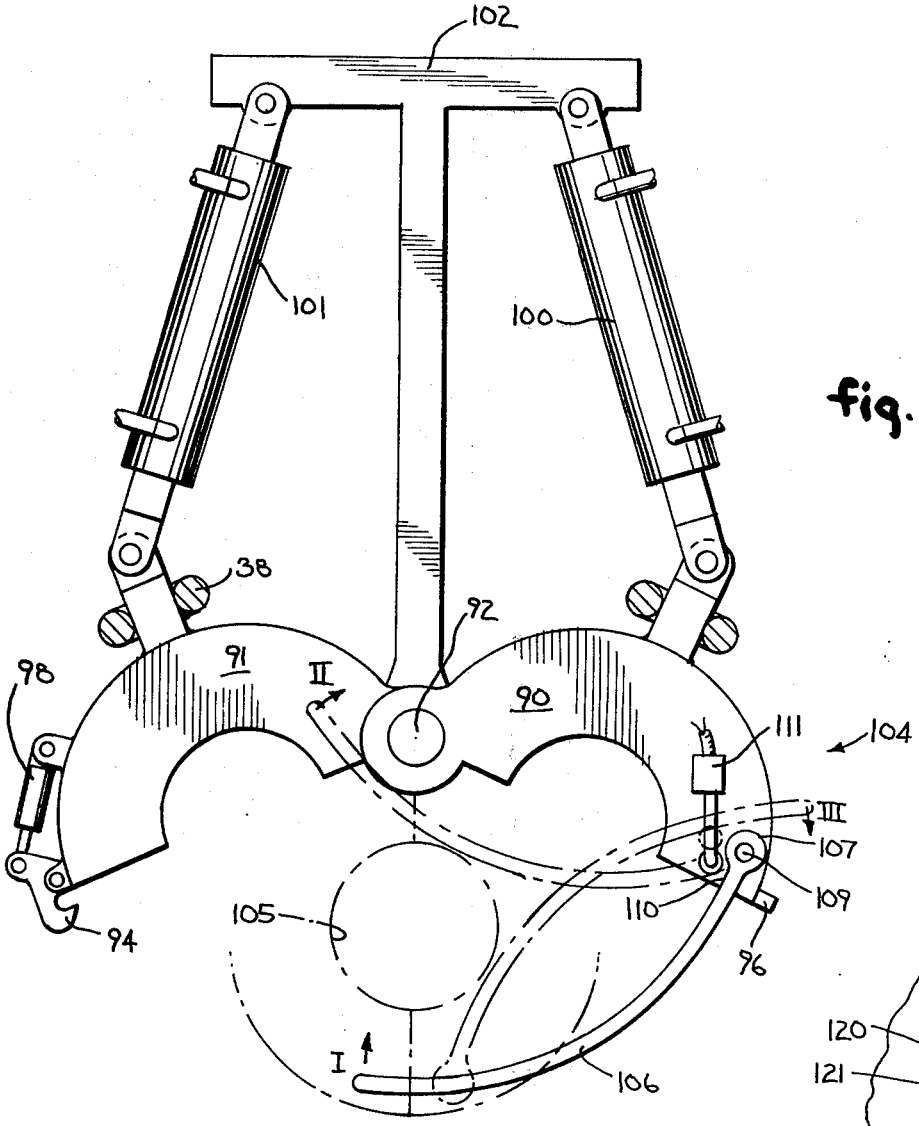
FIG. 5 is a plan view of a fluid powered pipe elevator incorporating the present invention.

FIG. 5 shows a set of pipe elevators which have been converted to automatic operation. Two annular body sections or jaws 90 and 91 are joined so as to open and close about a common axis 92. A latch 94 and catch bar 96 are provided to hold the jaws together. The latch 94 employs a spring or biasing member (not shown) so that the spring force must be opposed in order to disengage the elevator body sections.

The necessity of exerting muscular force to overcome the latch and operate the jaws at the fourble board (see FIG. 1) is a dangerous and fatiguing situation. This is also true for operations at the floor of the well but without the danger of height and limited space.

In order to overcome this burdensome situation, the latch 94 is provided with single acting fluid powered piston and cylinder assembly 98 (hereinafter called the "latch operator"). The injection of fluid into the cylinder will overcome the spring force and allow the elevator jaws 90 & 91 to be separated. When the elevator jaws are forced in the closed position, the latch 94 will automatically be applied by virtue of the biasing member.

In the specific embodiment illustrated in FIG. 6, the elevator jaws 90 & 91 are opened and closed by the use of double acting fluid powered piston and cylinder assemblies (hereinafter called the "elevator operators") 100 and 101. A T-shaped frame 102 extends from the common pivot point 92 of the body sections. The arms of this T-frame 102 are used as points of attachment for one end of the elevator operators 100 & 101.

Fluid is applied simultaneously to the closing side of each elevator operator 100 & 101 to close the elevator jaws 90 & 91. When the jaws come together, the latch 94 will engage the catch bar 96 on the opposite elevator body section to hold the jaws 90 and 91. One advantage of this scheme is that, should fluid power be lost, the elevator will "fail as is", meaning that, if the elevator jaws are closed, they will remain closed until the latch is released and the elevator jaws pulled apart.

The pipe elevator is equipped with a means 104 for sensing the relative position of a pipe stand 105 placed within the elevator. The position sensor 104 providing an "output signal" that is used to initiate the automatic closing of the elevators about the pipe stand. In the specific embodiment illustrated, the position sensor means 104 is activated when a pipe stand is inserted into the elevator jaws by the pipe transfer means.

The position sensor means 104 includes a curved bar 106. Curvature permits the bar 106 to slide smoothly along the pipe stand 105 as the pipe is inserted and withdrawn from the elevators. One end 107 of the bar 106 is pivotally connected to one of the elevator jaws, preferably the jaw 90 opposite to that jaw 91 on which the latch 94 is mounted. This serves to balance the two elevator jaws 90 & 91 and keeps the sensor means 104 from interfering with the latch assembly 94.

The curved bar 106 is biased to a first or extended position (I) by a suitable biasing means such as a torsion spring. The insertion of a pipe 105 into the elevators overcomes the biasing force and causes the curved bar 106 to be displaced from the extended position. As illustrated in FIG. 6 a torsion spring 108 is mounted coaxially with a pivot pin 109 for the curved bar 106. The extended position or first position I of the bar is shown in FIGS. 5 and 6 by solid lines. Subsequent positions are illustrated by phantom outline and sequential Roman numerals.

Figure 6:
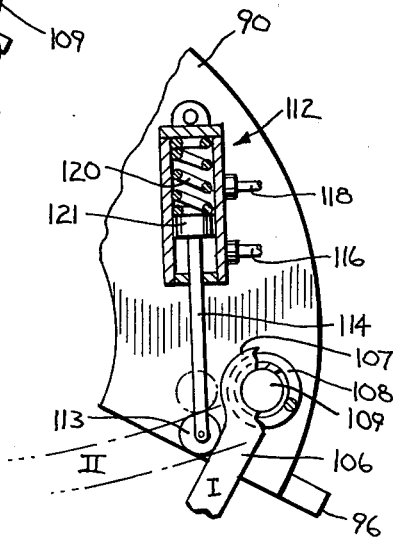
FIG. 6 is an enlarged fragmentary view of the sensing arm portion of FIG. 5.

One end 107 of the curved bar 106 acts as a camming surface 110 to actuate an electrical switch means 111 (FIG. 5) or valve means 112 (FIG. 6). Either device is mounted to one elevator jaw 90 to accommodate the camming action of the curved bar 106.

If an electrical switch means 111 is employed, additional valves would be necessary to control the fluid admitted to the closing side of the elevator operators. If a valve means 112 is used, the fluid to the closing side of the elevator operators would be controlled directly.

As detailed in FIG. 6, a spool valve 112 is used. A follower 113 at one end of a piston rod 114 of the valve 112 controls the flow of fluid between two fluid parts 116, 118. A spring 120 or other biasing means normally maintains the valve spool 121 in a position to prevent fluid from passing through the valve 112.

The curved bar 106 is rotated from the normally extended position (I) to a depressed or second position (II), by the insertion of a pipe stand 105 into the jaws 90 & 91 of the elevators. In this position (II), the valve means 112 or electrical switch means 111 is actuated by the camming surface 110 of the curved bar 106. This effectively "signals" that a pipe has been inserted within the elevators and that the elevator jaws 90 & 91 may be closed.

Finally, as the elevator jaws 90 & 91 are closed, the curved bar 106 is rotated still further in a clockwise direction to a third position (III). This position can be used to "signal" that the elevators have fully closed about a pipe section. This signal can be used to further direct the operation of components downstream the valve means 112 or electrical switch means 111. In such a case the switch means 111 would have a third set of contacts or the valve means would have an additional outlet port or a spool element 121 of another design. These variations in switch or valve design are well known to those skilled in the art.

The position of the curved bar 106 can serve to make the elevators open automatically. In that case a load sensing means (e.g. an electrical load cell added to the hook structure or a pressure switch attached to the elevator jaws sensing the shoulder or drill collar 28 of the pipe stand) would be used to signal that the weight of the pipe stand had been shifted from the elevator jaws. Under this configuration the elevators, with the curved bar 106 in the third position (III) and with the weight of the pipe shifted from the elevator jaws to the transfer means 124, the elevators would open automatically. This would reduce the dead time between pipe transfer operations and improve the overall efficiency of the system.

Although not shown in FIG. 6, an orifice or restriction in the opening lines to the elevator operators may be added permitting the admission of pressurized fluid to the opening sides of all three operators 98, 100, 101 simultaneously. In such a case the latch 94 would be released before the elevator jaws 90 & 91 would be pulled apart. A similar effect could be achieved by virtue of the smaller size of the latch operator relative to the elevator operators; it would take a greater volume of fluid to open the jaws than to open the latch. Thus all three operators could operate simultaneously and with a simplified control scheme.

When the elevator latch 94 is released and the elevator jaws opened, the curved bar 106 will be forced by the biasing means 108 to return to the extended position (I) as the pipe section 105 is withdrawn. Thus, the first position of the switch means 111 or the valve means 112 provides a "signal" that: (1) the elevators are open; (2) the pipe is withdrawn from the elevators; and (3) the pipe is sufficiently "clear" of the immediate vicinity of the pipe elevator that the elevators may be raised from the rotary table (i.e. when adding pipe to the drill string) or lowered from the area of the fourble board (i.e. when storing pipe removed from the drill string). In effect then, the position of the curved bar 106 provides a means of dynamically relating the position of a drill pipe section to a set of power activated pipe elevators.

FIG. 7 shows a transfer means 124 for moving drill pipe 34 between the elevators and the storage means 46. The transfer means 124 is mounted on the front of the drilling rig in the vicinity of the fourble board. It manipulates the upper end of drill pipe sections as they are stacked and unstacked from the storage means 46 or inserted and withdrawn from the elevators.

As specifically illustrated, the transfer means 124 includes a table 126 which is slidably connected to a support structure 128 so as to be free to move towards and away from the inside of the derrick. The support structure 128 is anchored to the derrick frame 44. This lateral movement is under the control of a shaft 130 which is part of a variable stroke, double acting, fluid powered piston and cylinder assembly (not shown). The table 126 supports a transfer arm frame 132 that is free to pivot about a vertical axis. The transfer arm frame 132 supports a second variable stroke, double acting, fluid powered piston and cylinder assembly 134 (hereinafter referred to as the "insertion operator") and two guide arms 136. The free end of the piston rod 137 of the insertion operator 134 is attached to a pipe grip including a mouth portion 138 and a pivoted closing lip portion 140. The closing lip is operated by a double acting, fluid powered, piston and cylinder assembly 142 attached to one of the guides 136. Closure of the lip 140 about a pipe section 143 locks the pipe section in the mouth 138 of the pipe grip. The transfer arm frame 132 is rotated by a bell crank 144 and a fluid powered, piston and cylinder assembly 146 attached to the table 126. Collectively, the insertion operator 134, the guide arms 136, and the pipe grip are referred to as the "transfer arm."

FIG. 8 shows the interface structure between the transfer means 124 and the storage means 46. In particular, a gate 148 and a pair of restraining bars 150 and 151 are attached to the transfer table 126. The gate 148 is actuated by a fluid powered piston and cylinder assembly 152 attached to the table 126. The gate and bars insure that stored sections of drill pipe 153 are kept within the confines of the finger boards 154.

FIG. 9 shows how the gate 148 telescopes along the restraining bar 151. This arrangement of the restraining bars and the gate keys the transfer means 124 to the fingerboards 154. Actuation of the bell crank 144 indexes the transfer arm to the centerline of the gate 148.

It is preferred that the pipe transfer means be controlled for synchronized semi-automatic movement by a member of the drilling crew. Such a control apparatus is conventional and is not described in detail.

While no valves have been shown for controlling fluid pressures in the various cylinders, they are conventional in design and in operation.

It should be noted that while a fluid control system has been assumed in describing the invention, the same effect could be produced by a suitable arrangement of electrical switches and motors—wherein the operation of the switches causes the actuation of certain motors (i.e., the motor shutting the elevator jaws or opening the elevator jaws). Similarly, the actuation of certain portions of the controlling network can be used to energize status lights indicating to personnel the condition of the equipment and other components for automatic actuation, or additional relays to control the operation of the transfer means and associated equipment.

It is envisioned that the previously described equipment will be integrated into a single system whereby the insertion and withdrawal of drill pipe from and between a pipe storage means and the tower elevators will be performed in coordinated fashion.

Taking Pipe Out Of The Well

The removal procedure is described by a sequence of elevation views in FIG. 10. The removal process follows conventional principles.

Figure 10D:
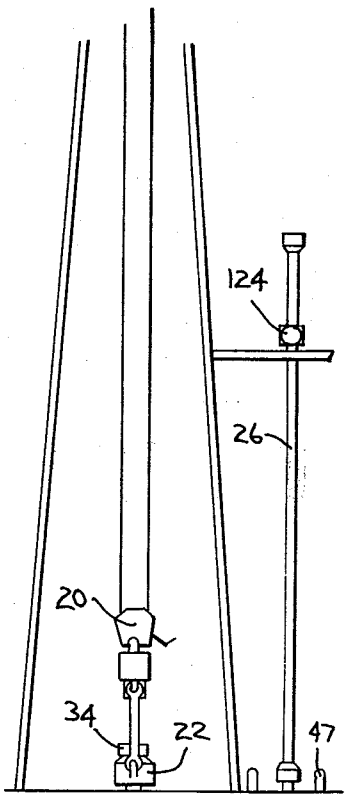
FIGS. 10A through 10D are elevation views illustrating the operational sequence of the preferred embodiment when used to remove pipe from the well drill string.
Figure 10C:
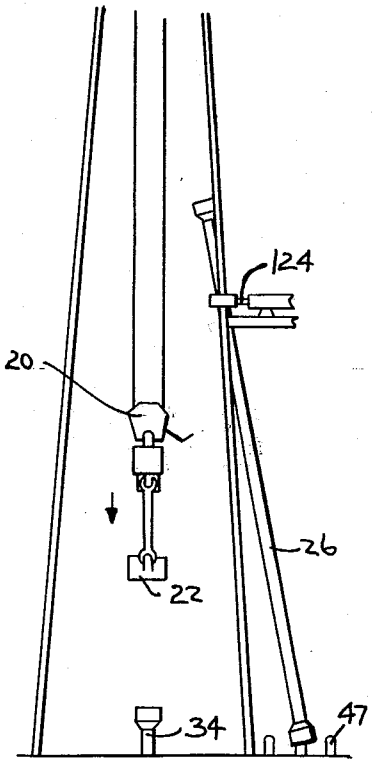
Figure 10B:
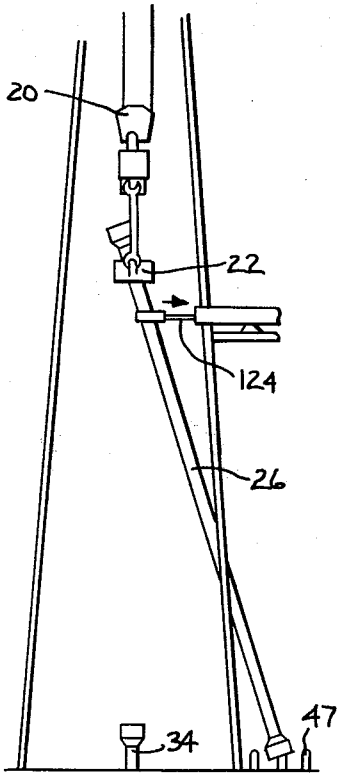
Figure 10A:
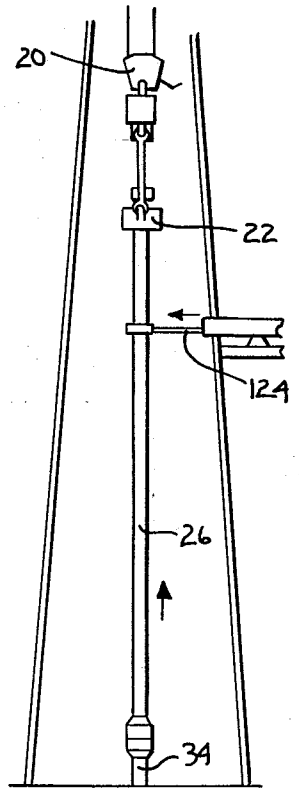

As shown in FIG. 10A after pipe section 26 has been pulled out of the well by the elevators 22, the transfer means 124 is extended and aligned to the pipe section 26. Next, the the pipe grip is closed; this supports the pipe against lateral movement. Floor operators can then separate the pipe stand from the remaining portion of the drill string.

After the pipe section 26 is disconnected from the drill string (FIG. 10B), the foot 27 of the pipe section is manually located in the storage means 46. Guides 47 may be used to align the foot 27 of the pipe stand in the storage means. Actuation of the latch operator and elevator operators opens the elevator jaws and separates the elevators from the pipe.

Referring to FIG. 10C, the transfer means 124 retracts to withdraw the pipe stand from the elevators 22 and move it into the storage means 46. Once the curved bar on the elevator 22 swings to the extended or "all clear" position, the elevators are free to be lowered to accept the next section of pipe to be removed from the well.

Finally, the transfer means 124 is rotated (FIG. 10D) in the direction of the finger boards. The gate is opened and the pipe stand is inserted into storage. The gate is shut, the pipe grip is opened, and the transfer means is withdrawn. The cycle is repeated as often as is necessary.

If automatic racking of drill pipe is desired, various operations may be effected automatically in a definite sequence under the control of automatic valves which, under certain conditions, may be actuated by trip devices or contact switches otherwise associated the equipment so that various functions may be effected automatically at the proper times.

Adding Pipe to the Well

The addition of pipe stands to the drill string is illustrated by a sequence of drawings shown in FIG. 11. The pipe insertion process more fully integrates the special features of the travelling block measuring arm and the pipe elevator curved bar.

Figures 11A, 11B, 11C, 11D, 11E, 11F:
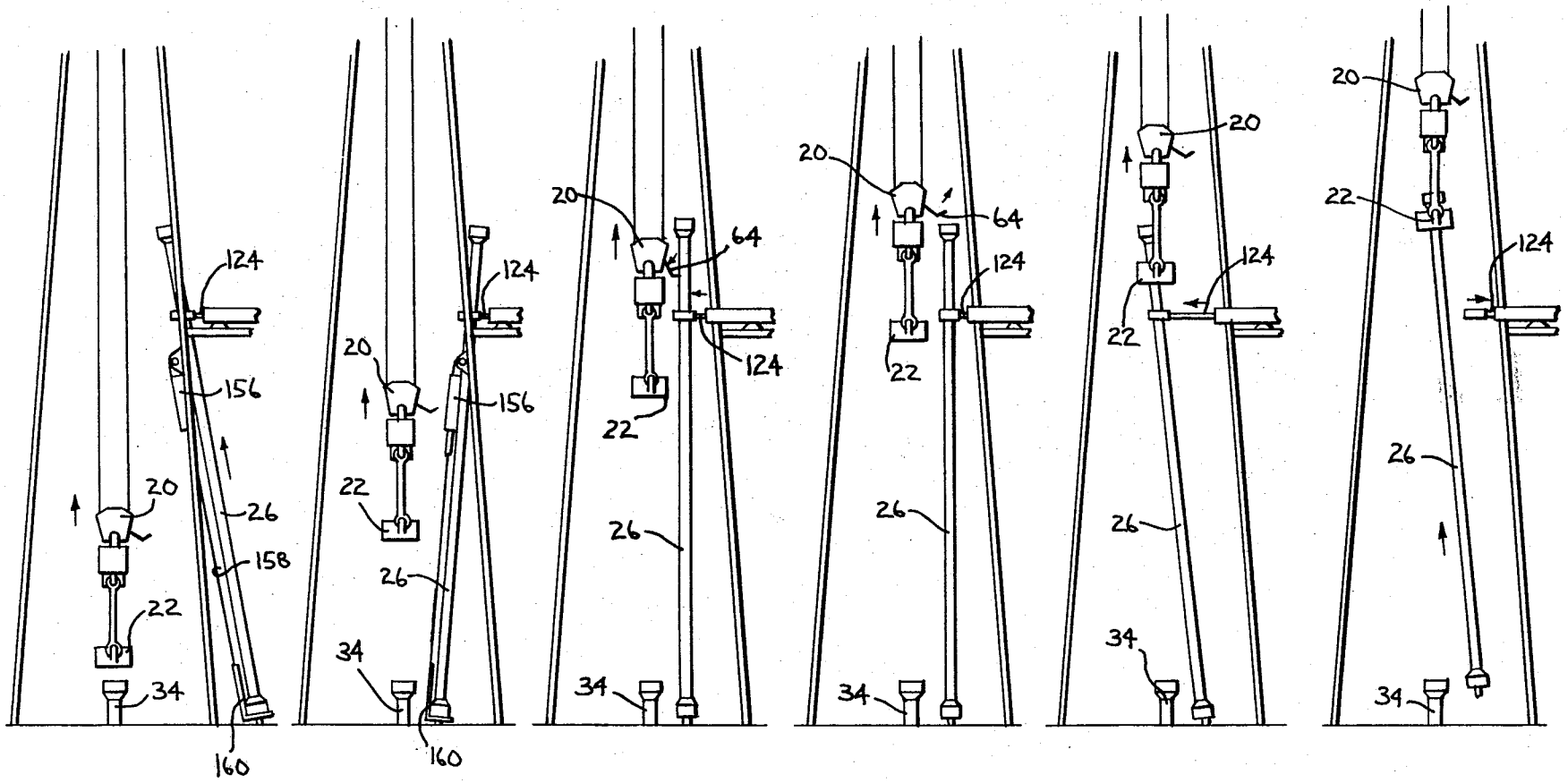
FIGS. 11A through 11F are elevation views illustrating the operational sequence of the preferred embodiment when used to add pipe to the well drill string.

The transfer means is actuated to remove from the storage means the upper end of the pipe stand to be added to the drill string (FIG. 11A). This operation is under the control of a member of the drilling crew stationed at the well head. The manipulation of the transfer means follows the principles previously described. While this operation is being conducted the elevators 22 are being raised from the bottom of the derrick. In practice it is found that removal of the top of the next pipe stand to be de-racked can, be accomplished in the time between de-racking and the lowering of the coupled pipe stand into the slips.

After the upper end of the pipe section has been withdrawn from the storage means (FIG. 11B) the lower end of the pipe stand is repositioned. To assist in the manipulation of the lower end of a pipe stand held within the pipe storage means, drilling crews often use a fluid powered, piston and cylinder assembly 156. (See FIG. 11A and 11B) A cable 158 joins the piston rod to a shoe 160 which is slipped under the foot of the pipe stand 26. Upon actuation of the piston and cylinder assembly 156, the lower end of the pipe stand is lifted. The floor operators may then easily move the foot of the pipe stand about the well head.

Next, (FIG. 11C) the upper end of the pipe stand is shifted to engage the measuring arm 64 carried by the travelling block 20. This depresses the measuring arm 64 from the normally extended position. The position of the measuring arm operates in conjunction with a contral system including a pulse counter. When the measuring arm is depressed a pulse counter is reset or initialized.

When the measuring arm 64 passes over the top of the pipe stand held by the transfer means (FIG. 11D), a pulse counter counting sequence is initiated. When the proper count has been reached, this indicates that the elevators are at the proper elevation for pipe insertion by the transfer arm. Similarly, intermediate counts may be used to incremently advance the transfer arm towards the elevaters thereby speeding the insertion process and minimizing time delays. Other uses of the signal initiated by the release of the measuring arm and the pulse generator previously described will be evident to one skilled in these operations.

When a pipe stand 26 is inserted (FIG. 11E) into the jaws of an open set of moving pipe elevators 22 by the transfer means 124, the curved bar mounted on the elevators is displaced from its normally extended position to a partially depressed position. This actuates a valve (or switch and set of switch controlled valves) thereby admitting pressurized fluid to the closing side of the elevator operators. This causes the pipe elevators to go shut.

As the pipe elevators become fully shut, the curved bar becomes fully depressed. This position of the curved bar may be used as a "signal" to the control system that the pipe stand has in fact been grasped by the elevators, and that the transfer means may be withdrawn. The signal to retract the transfer mechanism could also be given to the control system by a floor operator.

Finally, it should be noted that pressure switches may be employed at certain points on the conduit joining the piston and cylinder assemblies to the pressurized fluid source. For example, a pressure switch downstream from the spool valve 112 actuated by the curved bar 106 could be used to indicate that fluid has been admitted to the elevator operators. Similarly, a pressure switch corresponding to the third position of the curved bar could be used to indicate that the transfer means has fully inserted the pipe section and that the elevators are closed. This in turn could be used to signal to the floor operators that the transfer means may be withdrawn from the elevators.

While the running rigging has been assumed to follow a generally vertical line of travel, there may be situations (e.g. windy days, roll of a ship mounted drill rig, etc.) where tag lines may have to be employed to restrain the pendulous motion of the running rigging. These lines would not affect the operation of the invention or the method used to manipulate drill pipe.

While the invention has been described and shown with respect to specific embodiments, it will be readily apparent that variations are possible which would fall within the spirit of the present invention and that the invention is not to be limited, except by the scope of the appended claims.

I claim:

1. A well pipe elevator for raising and lowering pipe sections, comprising:

(a) a plurality of pipe encompassing body sections pivotally joined to swing between opened and closed positions;

(b) power actuated means carried by said body sections for swinging said body sections between open and closed positions; and (c) automatic means associated with said body sections and responsive to a pipe section being in a selected position adjacent said body sections for automatically operating said power actuated means to close said body sections so as to encompass and hold said pipe section within said body sections.

2. A pipe elevator for raising and lowering pipe sections, comprising:

(a) a plurality of pipe encompassing body sections joined together to swing between open and closed positions;

(b) power actuated means for swinging said body sections between open and closed positions; and (c) control means associated with said body sections and operatively associated with said power actuated means for signaling that said pipe section is within the compass of said body sections and affecting closure of said body sections such that closure of said body sections fully encompasses and holds said pipe section therewithin.

3. A pipe elevator for raising and lowering pipe sections, comprising:

(a) a plurality of pipe encompassing body sections pivotally joined to swing between opened and closed positions;

(b) means for swinging said body sections between open and closed positions; and (c) control means associated with said body sections and responsive to the insertion of said pipe section within the compass of said body sections for signaling that said pipe section is within the compass of said body sections and effecting closure of said body sections such that closure of said body sections fully encompasses and holds said pipe section therewithin, said control means including:

(a) an arm pivotally attached to one of said body sections, said arm following the position of said pipe section relative to said elevator body section;

(b) means for biasing said arm to a first position, said arm when in its first position being directed towards the opening in said body sections when said body sections are opened and said pipe section is outside the compass of said elevator; and (c) follower means responsive to the position of said arm for actuating said swinging means.

4. In equipment for use with a well drilling rig having a travelling block, a power transfer swivel suspended from said traveling block, a power operated pipe elevator suspended from said power transfer swivel, and a means for transferring pipe stands between a storage means and said elevator:

(a) means associated with said travelling block for activating said pipe transfer means when said elevator is at the proper elevation relative to said pipe stand for inserting said pipe stand into said elevator; and (b) means associated with said elevator for effecting the closure of said elevator when said pipe stand held by said pipe transferring means has been inserted into the compass of said elevator and for affecting the retraction of said transfer means.

5. In equipment used with a well drilling rig defined in claim 4 wherein said means for transferring pipe stands comprises:

(a) means for gripping pipe stands;

(b) a first variable stroke linear operator to position said pipe gripping means in a lateral direction, said first operator moving said gripping means between said elevator and said storage means;

(c) means for supporting said first operator;

(d) a platform upon which said support means is free to pivot, said platform means being slidably attached to said rig and being free to slide towards and away from said rig;

(e) a second linear operator pivotally attached to said platform, said second operator rotating said support means towards said storage means at one end of its stroke and toward said elevator at the opposite end of its stroke; and (f) a third variable stroke linear operator fixed to said rig at one end and attached to said platform at the other end, said third operator moving said support means along said platform towards and away from said rig whereby said pipe gripping means can be positioned in relation to the center of said rig and in the direction of said storage means.

6. In a well drilling rig having a travelling block, a power actuated pipe elevator suspended from said travelling block, means for raising and lowering said travelling block, means for storing pipe stands, and means for transferring pipe stands between said pipe elevator and said pipe storage means:

(a) first sensing means mounted on said travelling block for signaling when said travelling block is above the upper extremity of a pipe stand held by said pipe transfer means, said pipe transfer means responding to said first sensing means by inserting said pipe stand into the compass of said elevator without interferring with said travelling block or said raising and lowering means; and (b) second sensing means mounted on said pipe elevator for signaling when said pipe stand held by said pipe transfer means is sufficiently within said elevator such that closure of said elevator fully encompasses and holds said pipe stand.

7. In a well drilling rig as described in claim 6, wherein said second sensing means is an arm that is pivotally connected to said elevator and responsive to the insertion of said pipe stand within the compass of said elevator; a fluidic valve actuated by said arm; and biasing means, said arm normally being positioned by said biasing means to extend in the direction of the opening in said elevators so as to be engaged by a pipe stand being inserted into said elevators.

8. In a well drilling rig as described in claim 6, further including means responsive to the signal produced by said first sensing means for activating said pipe transfer means to insert said pipe stand into said elevator.

9. In a well drilling rig as described in claim 6, further including means responsive to said signal produced by said first sensing means for precluding closure of said pipe elevator until said elevator is at a selected elevation proper for the insertion of said pipe stand therein.

10. In a well drilling rig as described in claim 6, wherein said second sensing means further operates to detect closure of said elevator and provide a signal indicative thereof and wherein said pipe transfer means is withdrawn in response to said signal.

11. A method of moving pipe stands between a means for storing said pipe stands and a power actuated pipe elevator suspended from a travelling block of a drilling rig, comprising the following steps in sequence:

(a) positioning a means for transferring pipe stands in line with a pipe stand contained within said pipe storage means;

(b) gripping said pipe stand with said transfer means;

(c) moving said pipe stand held by said transfer means from the pipe storage means to the proximity of the path of travel of said travelling block;

(d) raising said elevator;

(e) measuring with means associated with said travelling block the elevation of said elevator relative to the upper end of said pipe stand held by said transfer means;

(f) inserting said pipe stand into said elevator with said transfer means when said elevator is at an elevation relative to said pipe stand held by said transfer means such that closure of said elevator will fully encompass and support said pipe stand;

(g) closing said elevator in response to means associated with said elevator for measuring the proximity of said pipe stand relative to the center of said elevator;

(h) releasing said pipe stand from said transfer means in response to said proximity measuring means when said elevator is fully closed;

(i) withdrawing said transferring means from the path of travel of said travelling block thereby permitting said pipe stand to be lowered by said elevator.

12. The method set forth in claim 11, wherein the step of moving the pipe stand from the pipe storage means to the proximity of the path of travel of the traveling block includes the steps of:

(a) gripping the upper end of said pipe stand by a power operated transfer means;

(b) moving the upper end of said pipe stand from the pipe storage means to the proximity of the path of travel of said travelling block using said power operated transfer means; and (c) moving the lower end of said pipe stand from said pipe storage means to the proximity of the path of travel of said travelling block.

13. The method of moving pipe stands set forth in claim 12, wherein the lower end of the pipe stand is moved from the pipe storage means to the proximity of the path of travel of the travelling block by lifting the lower end of said pipe stand with a cable and linear actuator carried by the drilling rig.

14. The method of moving pipe stands set forth in claim 11, further including the step of:

aligning said pipe stand in the approximately vertical direction after the pipe stand has been moved to the proximity of the path of travel of the travelling block.

15. The pipe elevator as set forth in claim 3, wherein said biasing means is carried by said body sections.

16. The pipe elevator set forth in claim 3, wherein said arm follows the position of said pipe section relative to the interior of said elevator body sections.

* * * * *